US007837484B2

(12) United States Patent
Wu

(10) Patent No.: US 7,837,484 B2
(45) Date of Patent: Nov. 23, 2010

(54) COVER MECHANISM AND ELECTRONIC DEVICE USING SAME

(75) Inventor: Zhong-Yun Wu, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/579,786

(22) Filed: Oct. 15, 2009

(65) Prior Publication Data

US 2010/0210125 A1 Aug. 19, 2010

(30) Foreign Application Priority Data

Feb. 17, 2009 (CN) ..... 2009 1 0300448

(51) Int. Cl.
*H01R 13/44* (2006.01)

(52) U.S. Cl. ..... 439/136

(58) Field of Classification Search ..... 439/136, 439/145, 439, 361; 312/293.1
See application file for complete search history.

(56) References Cited

U.S. PATENT DOCUMENTS

| | | | | | |
|---|---|---|---|---|---|
| 2,552,061 | A * | 5/1951 | Popp | 439/136 |
| 3,068,442 | A * | 12/1962 | Kubik et al. | 439/136 |
| 4,600,258 | A * | 7/1986 | Hu | 439/140 |
| 5,011,419 | A * | 4/1991 | Maan | 439/145 |
| 5,020,997 | A * | 6/1991 | Calderara et al. | 439/137 |
| 5,050,211 | A * | 9/1991 | Dortu et al. | 379/438 |
| 5,107,075 | A * | 4/1992 | Currier, Jr. | 174/67 |
| 5,165,042 | A * | 11/1992 | Klinger | 174/67 |
| 5,702,259 | A * | 12/1997 | Lee | 439/137 |
| 5,727,958 | A * | 3/1998 | Chen | 439/136 |
| 6,123,557 | A * | 9/2000 | Wang et al. | 439/137 |
| 6,461,195 | B2 * | 10/2002 | Chang | 439/620.32 |
| 6,537,088 | B2 * | 3/2003 | Huang | 439/137 |
| 6,652,297 | B1 * | 11/2003 | Zhang et al. | 439/136 |
| 6,951,469 | B1 * | 10/2005 | Lin | 439/135 |
| 6,988,903 | B1 * | 1/2006 | Cheng | 439/137 |
| 7,137,834 | B2 * | 11/2006 | Son | 439/136 |
| 7,382,611 | B2 * | 6/2008 | Tracy et al. | 361/679.41 |
| 7,521,632 | B2 * | 4/2009 | Johnson | 174/67 |
| 7,595,449 | B1 * | 9/2009 | Dyderski | 174/67 |
| 7,648,375 | B1 * | 1/2010 | Jiang | 439/136 |
| 7,651,346 | B2 * | 1/2010 | Francis et al. | 439/136 |
| 2004/0115978 | A1 * | 6/2004 | Hedayat et al. | 439/136 |
| 2009/0280664 | A1 * | 11/2009 | Francis et al. | 439/136 |

* cited by examiner

*Primary Examiner*—T C Patel
*Assistant Examiner*—Vladimir Imas
(74) *Attorney, Agent, or Firm*—Steven M. Reiss

(57) ABSTRACT

A cover mechanism for an electronic device includes a base member and a cover combination. The base member defines a hole. The cover combination includes a cover member and at least one elastic member. One end of the at least one elastic member is attached to the cover member, another end of the at least one elastic member is attached to the base member. The cover member is slidably assembled into the base member, and the at least one elastic member provides an elastic force to allow the cover member to releasably cover the hole.

15 Claims, 5 Drawing Sheets

COVER MECHANISM AND ELECTRONIC DEVICE USING SAME

BACKGROUND

1. Technical Field

The present disclosure relates to cover mechanisms used in electronic devices (e.g., mobile phones).

2. Description of Related Art

Electronic devices usually have external interfaces (e.g., universal serial bus (USB)) for electrically connecting peripheral devices (e.g., printers), accessories (e.g., USB flash drives) or other electronic devices. Such external interfaces should be protected by cover mechanisms from e.g., dust or water, to maintain proper functioning.

The cover mechanisms usually include covers with locks. The covers are typically locked to the electronic devices by latches to cover the area through which the interfaces of electronic devices are exposed. However, the covers are often not permanently attached to the electronic device. Thus, the covers may easily be misplaced or lost when not locked to the electronic devices.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the present cover mechanism. Moreover, in the drawings, like reference numerals designate corresponding parts throughout the several views, in which.

DETAILED DESCRIPTION

Figure 1:
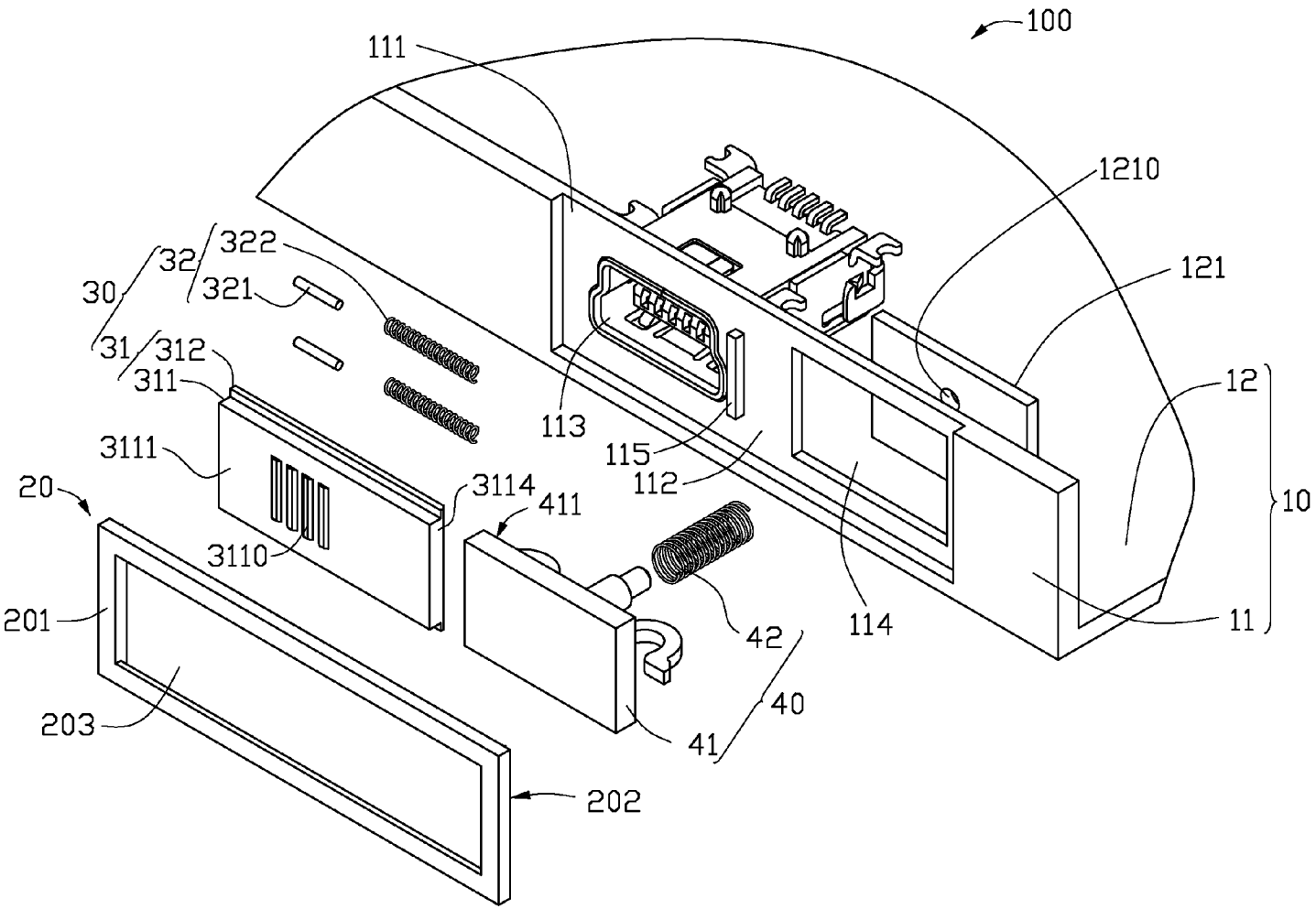
FIG. 1 is an exploded, isometric view of an exemplary cover mechanism used in an electronic device.
Figure 2:
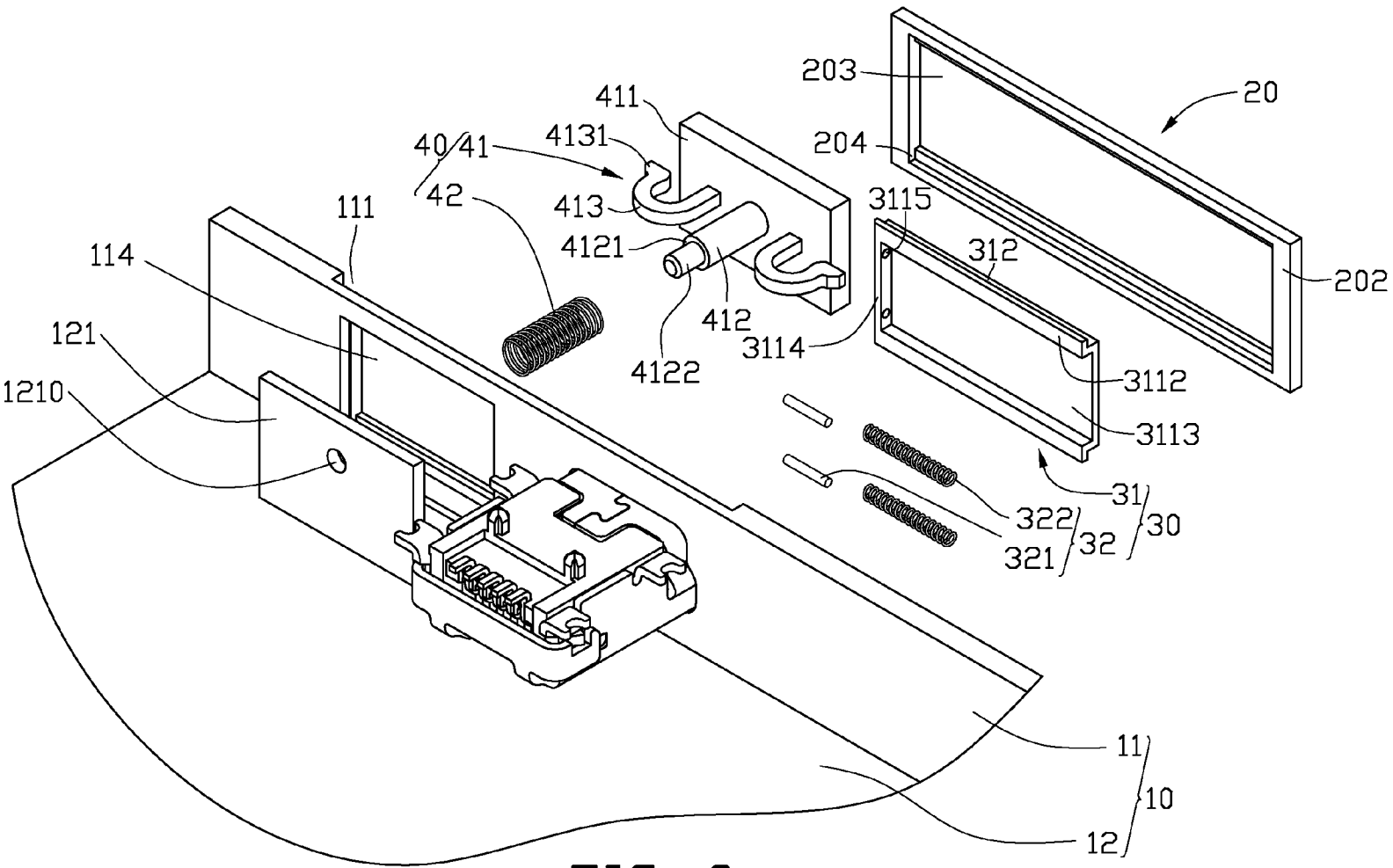
FIG. 2 is similar to FIG. 1, showing another aspect thereof.

FIG. 1 shows an exemplary embodiment of a cover mechanism 100 used to an electronic device, such as a mobile phone.

The cover mechanism 100 includes a base member 10, a fixing member 20, a cover combination 30 and a locking mechanism 40.

The base member 10 may be portions of the electronic device and includes a sidewall 11 and a bottom wall 12 perpendicular to the sidewall wall 11. The sidewall 11 defines a rectangular groove 111 and forms a bottom portion 112. The bottom portion 112 defines an interface hole 113 and a locking hole 114, and forms a rib 115 between the interface hole 113 and the locking hole 114. A connector (not labeled) is positioned at the bottom wall 12, and one end of the connector is received in the interface hole 113. A stopper plate 121 is perpendicularly positioned on the bottom wall 12, and is aligned with the locking hole 114. The stopper plate 121 defines a pin hole 1210.

The fixing member 20 is substantially a rectangular frame, and includes an outer surface 201 and an inner surface 202. The outer surface 201 defines a rectangular opening 203 through the inner surface 202. The inner surface 202 defines a guiding slot 204 along the length of the opening 203. The fixing frame 20 is used for being received in the groove 111, and is secured therein by e.g. hot melting.

The cover combination 30 includes a cover member 31 and at least one, but preferably two groups of biasing mechanisms 32. The cover member 31 includes a main body 311 and two lateral edges 312 extending from two sides of the main body 311. The main body 311 includes a first surface 3111 and a second surface 3112. The first surface 3111 forms a plurality of spaced projections 3110 for conveniently operating the cover member 31 using an operator's finger. The second surface 3112 is recessed to define a receiving space 3113. The receiving space 3113 communicates with one end of the main body 311, and forms a side portion 3114 at the other end. The side portion 3114 longitudinally defines two shaft holes 3115. Each biasing mechanism 32 includes a shaft 321 and a first elastic member 322. One end of the shafts 321 may be fixed in a corresponding shaft hole 3115, and the first elastic members 322 are respectively placed around the shafts 321. One end of the first elastic members 322 resist the side portion 3114, and the other end of the first elastic members 322 resist the rib 115 of the base member 10.

The locking mechanism 40 includes a locking member 41 and a second elastic member 42. The locking member 41 includes a rectangular pressing portion 411, a pin portion 412 and two deformable portions 413. The pressing portion 411 is used for abutting the cover member 31 to allow the cover member 31 to stably cover the interface hole 13 and not inadvertently uncover the interface hole 13. The pressing portion 411 may be pressed into the locking hole 114 to unlock and allow the cover member 31 to move away from the interface hole 13. The pin portion 412 is a stepped cylinder, and includes a stepped surface 4121 and a smaller diameter end 4122. The smaller diameter end 4122 may be slidably inserted into the pin hole 1210 of the stopper plate 121 until the stepped surface 4121 abuts the stopper plate 121. Two deformable portions 413 are respectively formed at two sides of the pin portion 412. Each deformable portion 413 is arcuate, and has a distal end 4131. The second elastic member 42 is a helical spring, and may be placed around the pin portion 412.

Figure 3:
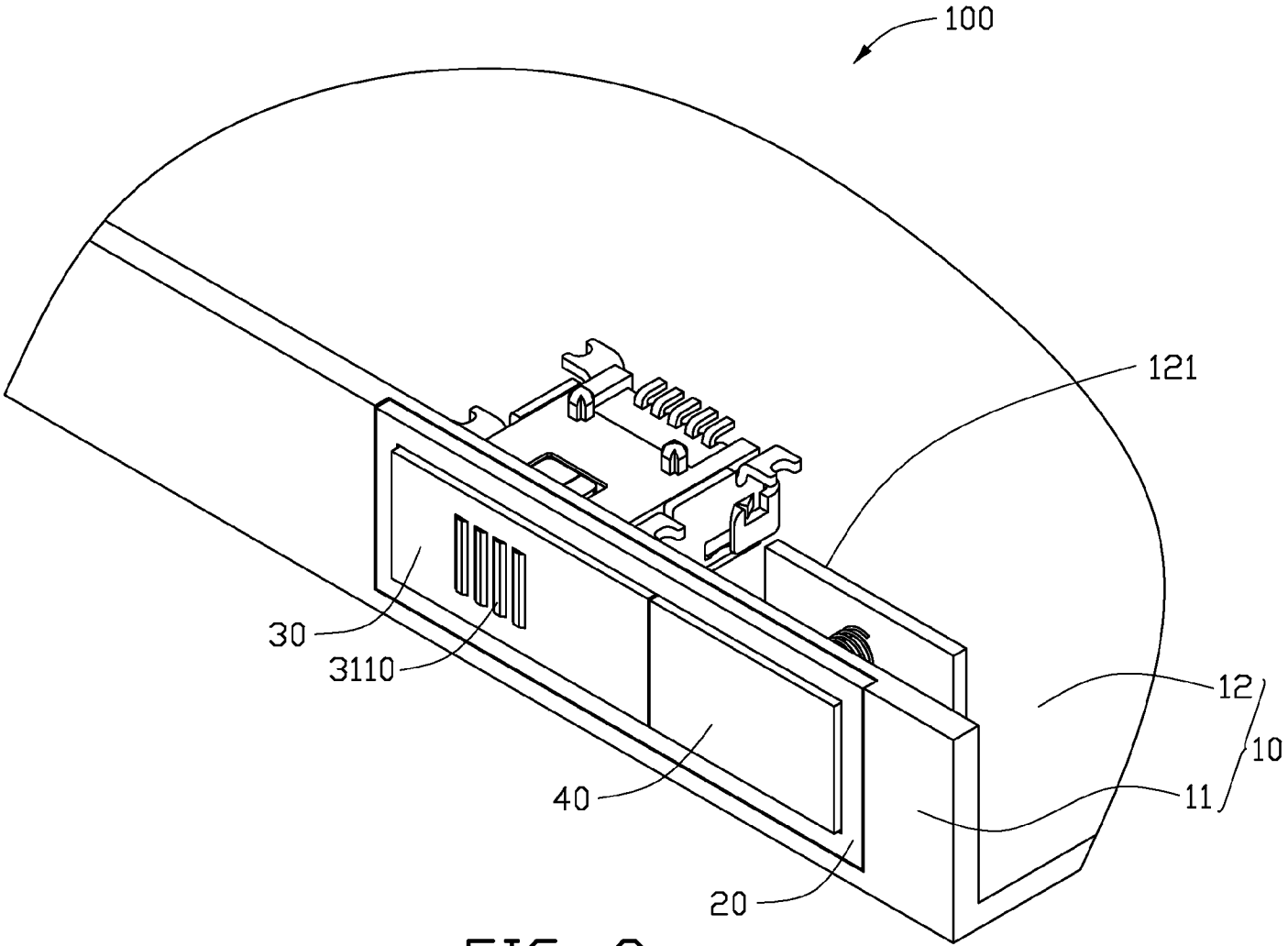
FIG. 3 is an assembled, isometric view of the exemplary cover mechanism shown in FIG. 1.

In FIG. 3, when the cover mechanism 100 is assembled, firstly, the biasing mechanism 32 is assembled to the cover member 31. One end of each shaft 321 is fixed into the shaft hole 3115 of the cover member 31. Each first elastic member 322 is placed around the shaft 321 from the other end of each shaft 321. Secondly, the cover member 31 is positioned in the groove 111 to cover the locking hole 114. One end of the first elastic members 322 resist the side portion 3114, and the other end of the first elastic members 322 resist the rib 115 of the base member 10. In an initial state, the first elastic members 322 have a predetermined compressible force for the cover member 31. Then, the fixing frame 20 is fixed in the groove 111 by hot melting, thereby sandwiching the cover member 31. The lateral edges 312 are received in the guiding slot 204 of the fixing frame 20.

After that, the locking member 41 is assembled in the base member 10. Firstly, the cover member 31 is slid along the guiding slot 24 of the fixing member 20. The first elastic members 322 are compressed to accumulate elastic energy. The cover member 31 slides to cover the interface hole 113, and exposes the locking hole 114. Then, the locking member 41 is positioned in the groove 111 and outside the locking hole 114. The second elastic member 42 is placed around the pin portion 412. The smaller diameter end 4122 is slidably received in the pin hole 1210 of the stopper plate 121. One side of the locking member 41 abuts the cover member 31 to limit the cover member 31's ability to slide. Thus, the cover mechanism 100 is completely assembled.

Figure 4:
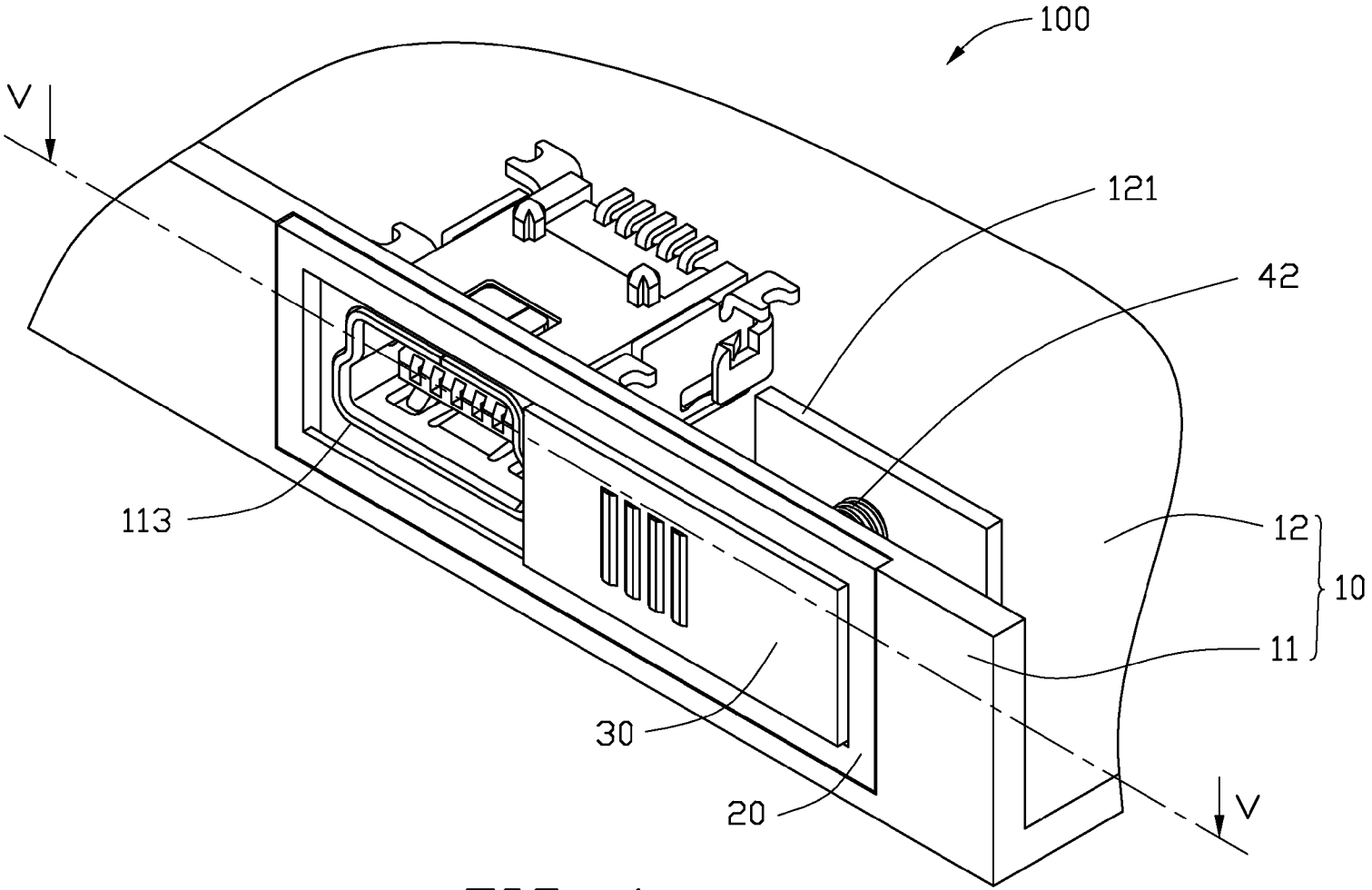
FIG. 4 is similar to FIG. 3, but in an opened position of the cover mechanism.
Figure 5:
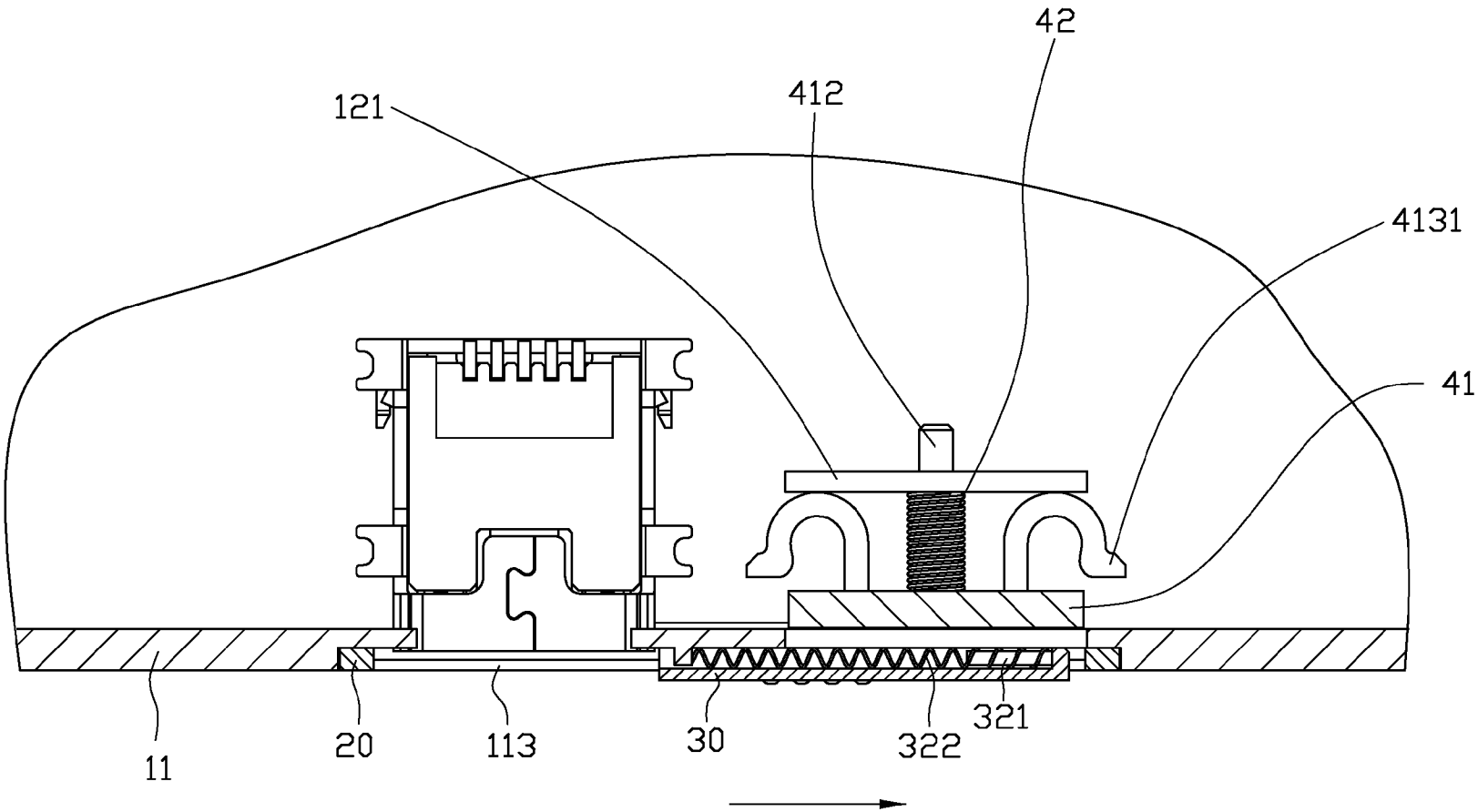
FIG. 5 is a cross sectional view of the cover mechanism shown in FIG. 4 taken along line V-V.

Referring to FIGS. 4 and 5, when the cover member 31 is opened, the operator may press the locking member 41 into the locking hole 114. The second elastic member 42 is compressed, and the two deformable portions 413 are deformed to allow the locking member 41 to slide in the locking hole 114. The cover member 31 is released from the limitation of the locking member 41 and can now automatically slide under the force of the first elastic members 322 along the arrow direction of FIG. 5. Thus, the interface hole 113 is exposed from the base member 10 for insertion of one of various kinds of plugs.

To close and lock the cover mechanism 100, the above process is reversed and the cover member 31 moved from the opened position to the closed position. The closing process ends when the locking member 41 abuts the cover member 31.

It is to be understood, however, that even through numerous characteristics and advantages of the exemplary invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cover mechanism for an electronic device, the cover mechanism comprising:

a base member defining an interface hole and a locking hole;

a cover combination including a cover member and at least one elastic member, one end of the at least one elastic member attached to the cover member, another end of the at least one elastic member attached to the base member; the cover member being slidably assembled to the base member, and the at least one elastic member biasing the cover member towards a position releasably covering the interface hole;

a locking member elastically and movably attached to the base member and contained inside the locking hole, the locking member separately abutting a portion of the cover member to selectively prevent movement of the cover member;

wherein pressing the locking member into the locking hole causes the locking member to move out of a path of the cover member to unlock the cover member, allowing the cover member to automatically move towards a position where the cover member does not cover the interface hole.

2. The cover mechanism as claimed in claim 1, further comprising another elastic member, wherein the locking member includes a pin portion, another elastic member is placed around the pin portion.

3. The cover mechanism as claimed in claim 1, further comprising at least one shaft, wherein the base member forms a rib, the cover member forms a side portion defining at least one pin hole, one end of the shaft fixed to a corresponding pin hole, the elastic member is placed around a corresponding shaft, and is positioned between the side portion and the rib.

4. The cover mechanism as claimed in claim 1, further comprising a fixing member, wherein the fixing member defines a rectangular opening and a guiding slot along the length of the opening, the cover member sandwiched between the fixing member and the base member, and the cover member slidable in the guiding slot.

5. The cover mechanism as claimed in claim 1, further comprising another elastic member, another elastic member provides an elastic member to bias the locking member towards a position outside of the locking hole.

6. The cover mechanism as claimed in claim 5, wherein the locking member includes a pressing portion, a pin portion and two deformable portions, the pin portion extends from one side of the pressing portion, the two deformable portions are formed at two sides of the pin portion, another elastic member is placed around the pin portion.

7. The cover mechanism as claimed in claim 6, wherein each deformable portion is arcuate.

8. An electronic device, comprising:

a housing;

a cover mechanism, comprising:

a base member being a portion of the housing, the base member defining an interface hole and a locking hole;

a locking member being attached to the base member to be located inside or outside of the locking hole;

a cover member attached to the base member for movement between:

a closed position, where the cover member abuts the locking member to cover the interface hole of the base member; and an opened position, where the locking member is pushed into the locking hole to unlock the cover member, whereby the cover member can automatically slide toward the locking hole to expose the interface hole.

9. The electronic device as claimed in claim 8, further comprising a first elastic member, one end of the elastic member attached to the cover member, another end of the elastic member attached to the base member.

10. The electronic device as claimed in claim 9, further comprising a second elastic member, wherein the locking member includes a pin portion, the second elastic member is placed around the pin portion.

11. The electronic device as claimed in claim 10, wherein the locking member includes a pressing portion, and two deformable portions, the two deformable portions are formed at two sides of the pin portion.

12. The electronic device as claimed in claim 11, wherein each deformable portion is arcuate.

13. The electronic device as claimed in claim 8, further comprising a shaft, wherein the base member forms a rib, the cover member forms a side portion defining a pin hole, one end of the shaft fixed to the pin hole, the elastic member is placed around the shaft, and is posited between the side portion and the rib.

14. The electronic device as claimed in claim 8, further comprising a fixing member, wherein the fixing member defines a rectangular opening and a guiding slot along the length of the opening, the cover member sandwiched between the fixing member and the base member, and the cover member slidable in the guiding slot.

15. The cover mechanism as claimed in claim 1, wherein the interface hole and the locking hole are separate and discrete side-by-side holes.

* * * * *